US005138770A

United States Patent [19]

Matsuyama

[11] Patent Number: 5,138,770

[45] Date of Patent: Aug. 18, 1992

[54] EYEGLASSES FRAME TRACING DEVICE

[75] Inventor: Yoshinori Matsuyama, Gamagori, Japan

[73] Assignee: Nidek Co., Ltd., Gamagori, Japan

[21] Appl. No.: 749,838

[22] Filed: Aug. 26, 1991

[30] Foreign Application Priority Data

Aug. 28, 1990 [JP] Japan ..... 2-227623

[51] Int. Cl.[5] ..... G01B 7/28

[52] U.S. Cl. ..... 33/28; 33/507; 33/200; 33/553; 33/551

[58] Field of Search ..... 33/28, 200, 507, 551, 33/553, 554, DIG. 3, 572, 555, 1 M; 51/101 LG

[56] References Cited

U.S. PATENT DOCUMENTS

| | | | |
|---|---|---|---|
| 4,051,601 | 10/1977 | Godot | 33/200 |
| 4,724,617 | 2/1988 | Logan et al. | 33/28 |
| 4,991,305 | 2/1991 | Saigo et al. | 33/28 |
| 4,995,170 | 2/1991 | Brulé et al. | 33/200 |

FOREIGN PATENT DOCUMENTS

| | | | |
|---|---|---|---|
| 0305308 | 12/1989 | Japan | 33/507 |
| 0020602 | 1/1991 | Japan | 33/507 |
| 0020604 | 1/1991 | Japan | 33/507 |
| 0020605 | 1/1991 | Japan | 33/507 |

*Primary Examiner*—William A. Cuchlinski, Jr.
*Assistant Examiner*—William C. Dowling
*Attorney, Agent, or Firm*—Armstrong, Nikaido, Marmelstein, Kubovcik & Murray

[57] ABSTRACT

An eyeglasses frame tracing device used in an eyeglasses lens grinding machine. The eyeglasses frame tracing device of the invention comprises a horizontally movable base portion, a rotary base rotatably supported on the base portion, a shaft including a measuring element at its upper end, the shaft being retained on the rotary base so as to relatively move in the vertical and lateral direction with respect to the rotary base, a light-shielding plate which moves in association with the vertical movement and lateral movement of the measuring element shaft and which has openings to allow a part of light to pass therethrough, and a pair of a light emitting section and a light receiving section which are provided opposite to each other with the light-shielding plate interposed therebetween and which moves integrally with the rotary base. Instead of the light-shielding plate, the device may comprise a light emitting section which moves in association with the vertical movement and the lateral movement of the measuring element shaft, and a light receiving section including an area image sensor, which corresponds to the light emitting section and moves integrally with the rotary base. With such structure, because one detector determines a three-dimensional position of the eyeglasses frame, the device can be reduced in size and a manufacturing cost of the device can be decreased.

4 Claims, 7 Drawing Sheets

EYEGLASSES FRAME TRACING DEVICE

BACKGROUND OF THE INVENTION

1. Industrial Field of the Invention

The present invention relates to an eyeglasses frame tracing device which is convenient for use in an eyeglasses grinding machine.

2. Description of the Related Art

In recent years, a lens grinder which automatically grinds an edge of an eyeglasses lens has been popularized rapidly. At the same time, various kinds of eyeglasses frame tracing devices for previously measuring data related to a variable radius of a lens frame have been developed. However, any of these eyeglasses frame tracing devices measures the variable radius data of the lens frame by two dimensions so that it cannot determine correctly a curved outline of the lens frame having three dimensions.

Under such circumstance, various kinds of eyeglasses frame tracing devices for correctly determining a curved outline of a lens frame having three dimensions have recently been proposed. Two detectors are required for positional detection in such three-dimension eyeglasses frame tracing device, in order to detect an amount of displacement along the lens frame in a direction of a variable radius and an amount of displacement of the lens frame in a direction perpendicular to the variable radius.

SUMMARY OF THE INVENTION

However, in case of using two detectors, there exist such problems that the eyeglasses frame tracing device is increased in size and that manufacturing cost of the device unfavorably becomes high.

Taking the above-described problems into account, the present invention has an object to provide a three-dimension eyeglasses frame tracing device which is reduced in size and whose manufacturing cost is decreased.

An eyeglasses frame tracing device according to the invention is characterized in that it comprises a horizontally movable base portion, a rotary base rotatably supported on the base portion, a shaft having a measuring element at its upper end, the shaft being retained on the rotary base and vertically and laterally moving relatively with respect to the rotary base, a light-shielding plate which moves in association with the vertical and lateral movement of the measuring element shaft and which has opening means to allow a part of light to pass therethrough, and a pair of a light emitting section and a light receiving section which are provided opposite to each other with the light-shielding plate being interposed therebetween and which move integrally with the rotary base.

The eyeglasses frame tracing device of the invention is characterized in that the opening means is at least two slits extending non-parallel with each other and that the light receiving section is a linear image sensor.

The eyeglasses frame tracing device of the invention is characterized in that the opening means is replaced by a pin hole and that the light receiving section is an area image sensor.

Alternatively, the eyeglasses frame tracing device is characterized in that the light emitting section moves in association with the vertical and lateral movement of the measuring element shaft and that the light-shielding plate with the pin hole is eliminated.

DETAILED DESCRIPTION OF THE PREFERRED EMBODIMENTS

Before explaining an eyeglasses frame tracing device according to the present invention, a structure of a lens grinder on which the tracing device is mounted will now be briefly described.

Figure 6:
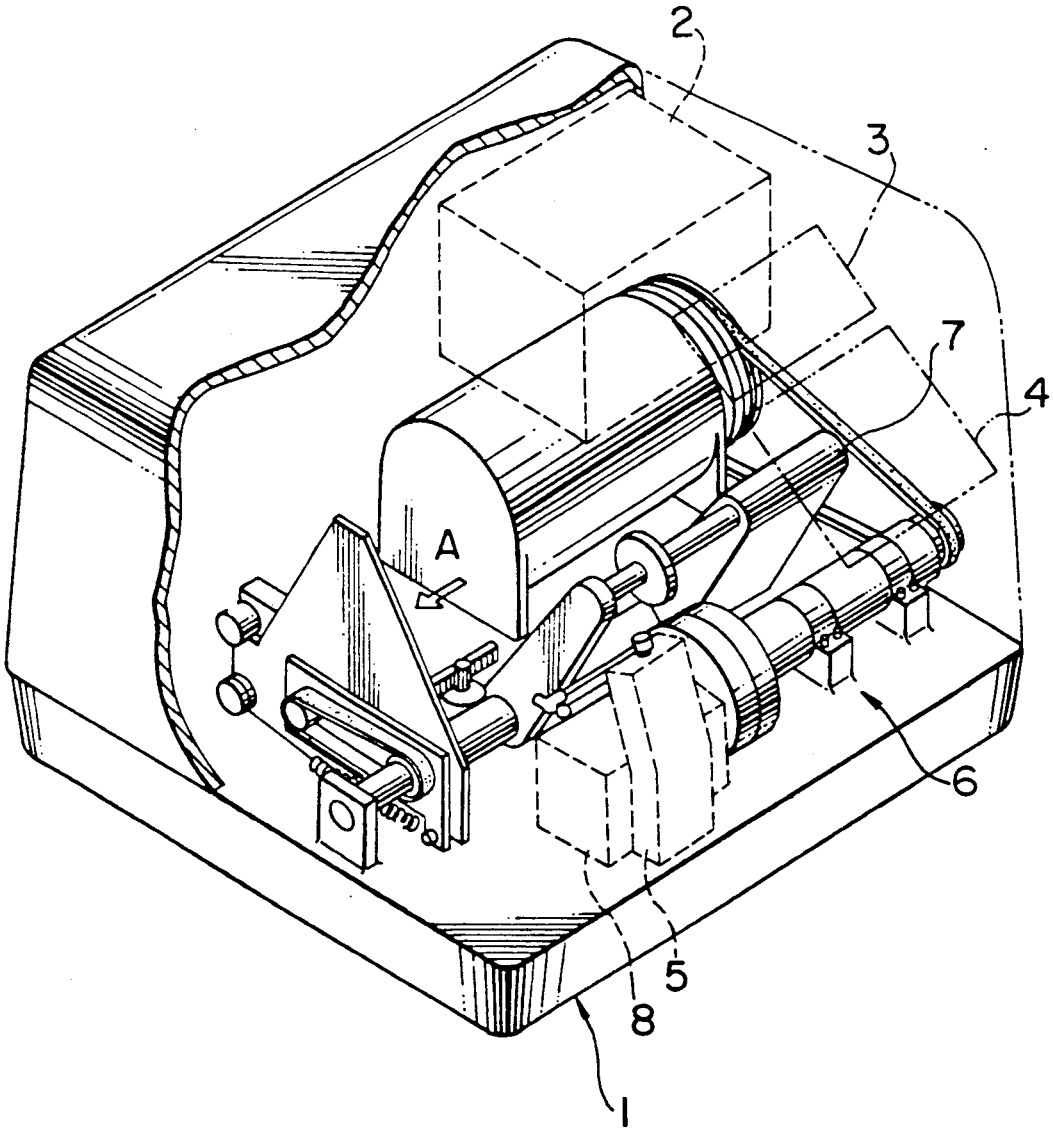
FIG. 6 is a perspective view showing a whole structure of a lens grinder.

FIG. 6 is a perspective view showing a whole structure of a lens grinder.

Reference numeral 1 designates a base and component parts which constitute the lens grinder are disposed on the base 1.

Figure 7:
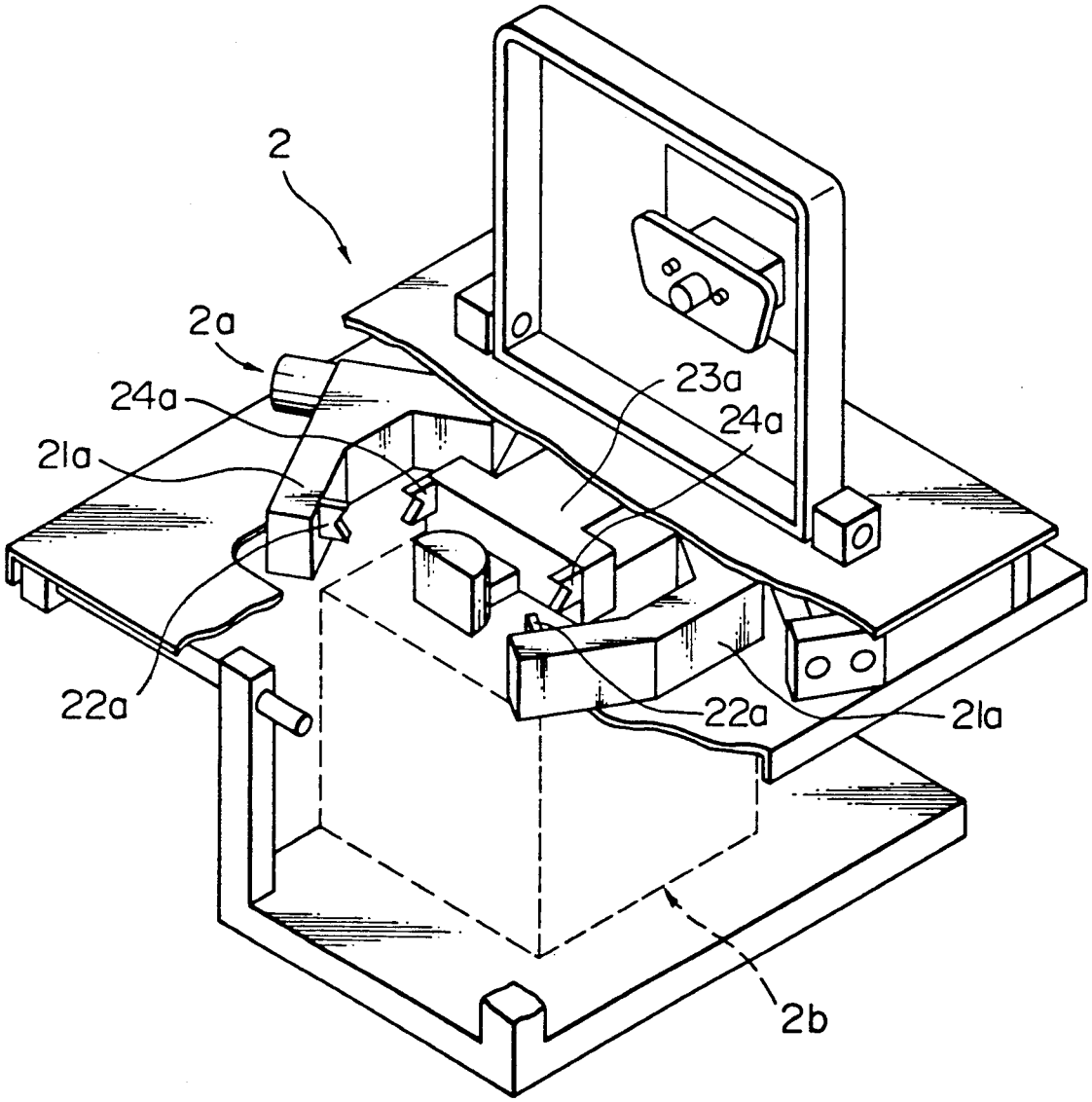
FIG. 7 is a perspective view showing a whole structure of the eyeglasses frame tracing device.

Reference numeral 2 shows an eyeglasses frame tracing device which is contained in a housing of the lens grinder and which occupies an upper portion of the interior space within the housing. The eyeglasses frame tracing device 2 generally comprises, as shown in FIG. 7, a clamp portion **2*a* for holding eyeglasses and a detecting portion 2*b* which scans a frame while it is contacting with the frame for detection of a configuration of the frame. Strictly speaking, the present invention concerns the above detecting portion 2*b***.

As illustrated in FIG. 7, the clamp portion **2*a* is arranged such that it holds the eyeglasses frame horizontally from the outside thereof by means of claws 2*a* attached to a pair of arms 21*a* and claws 24*a* attached to a central arm 23*a***.

There are provided a display portion 3 and an input portion 4 in front of the eyeglasses frame tracing device 2, the display portion 3 displaying measured or calculated results by letters or graphics and the input portion 4 inputting data or commanding the lens grinder 1.

A lens-shape determining device 5 for determining an imaginary edge thickness of a lens which is not processed is set at a front portion of the lens grinder 1.

Reference numeral 6 denotes a lens-grinding portion of the lens grinder 1 and reference numeral 7 denotes a carriage portion of the same. Further, reference numeral 8 shows a bevel curve processing portion for providing a bevel curve and a flat surface of the lens edge.

Figure 1:
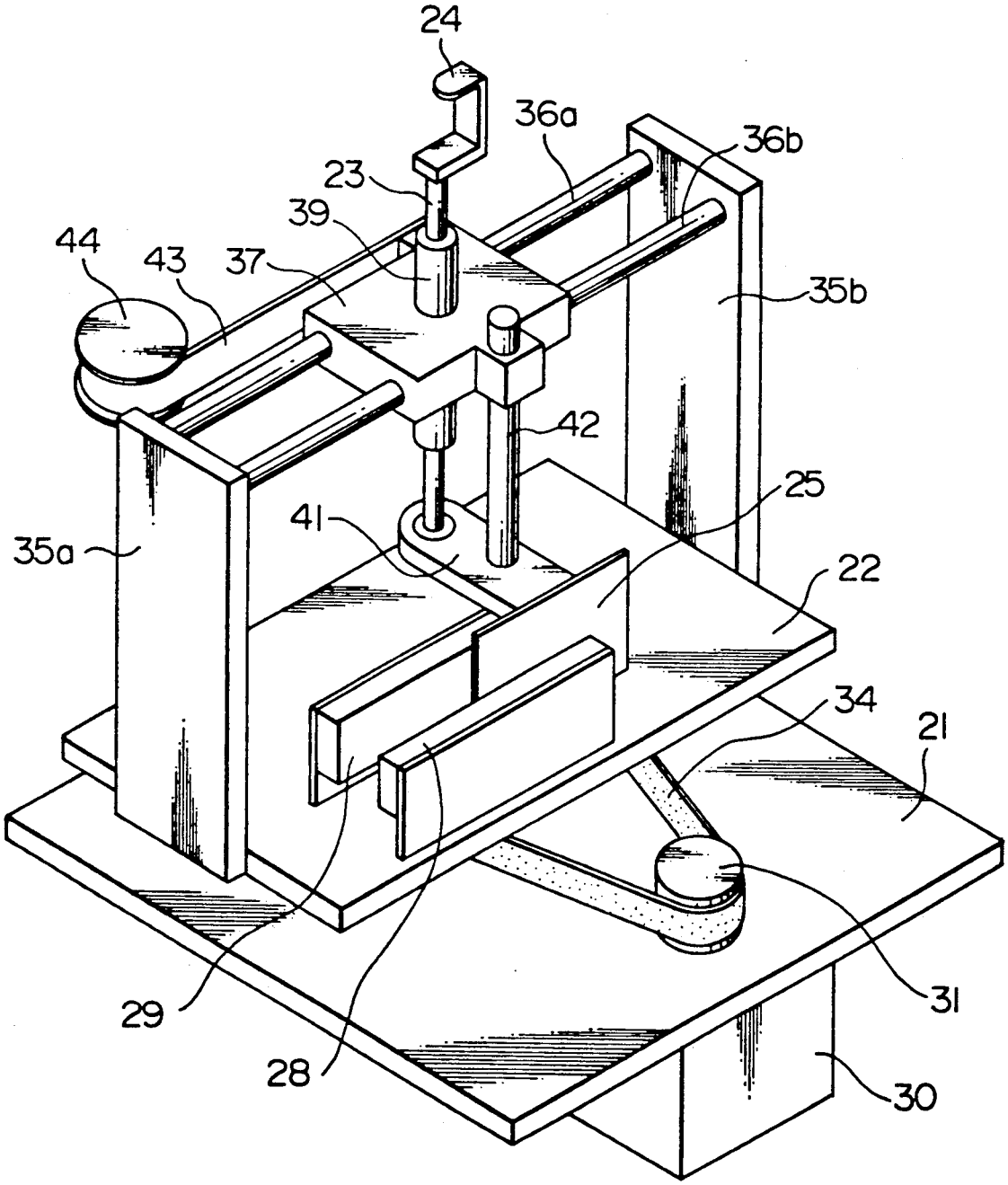
FIG. 1 is a perspective view showing a detecting portion of an eyeglasses frame tracing device of a first embodiment according to the present invention.
Figure 2:
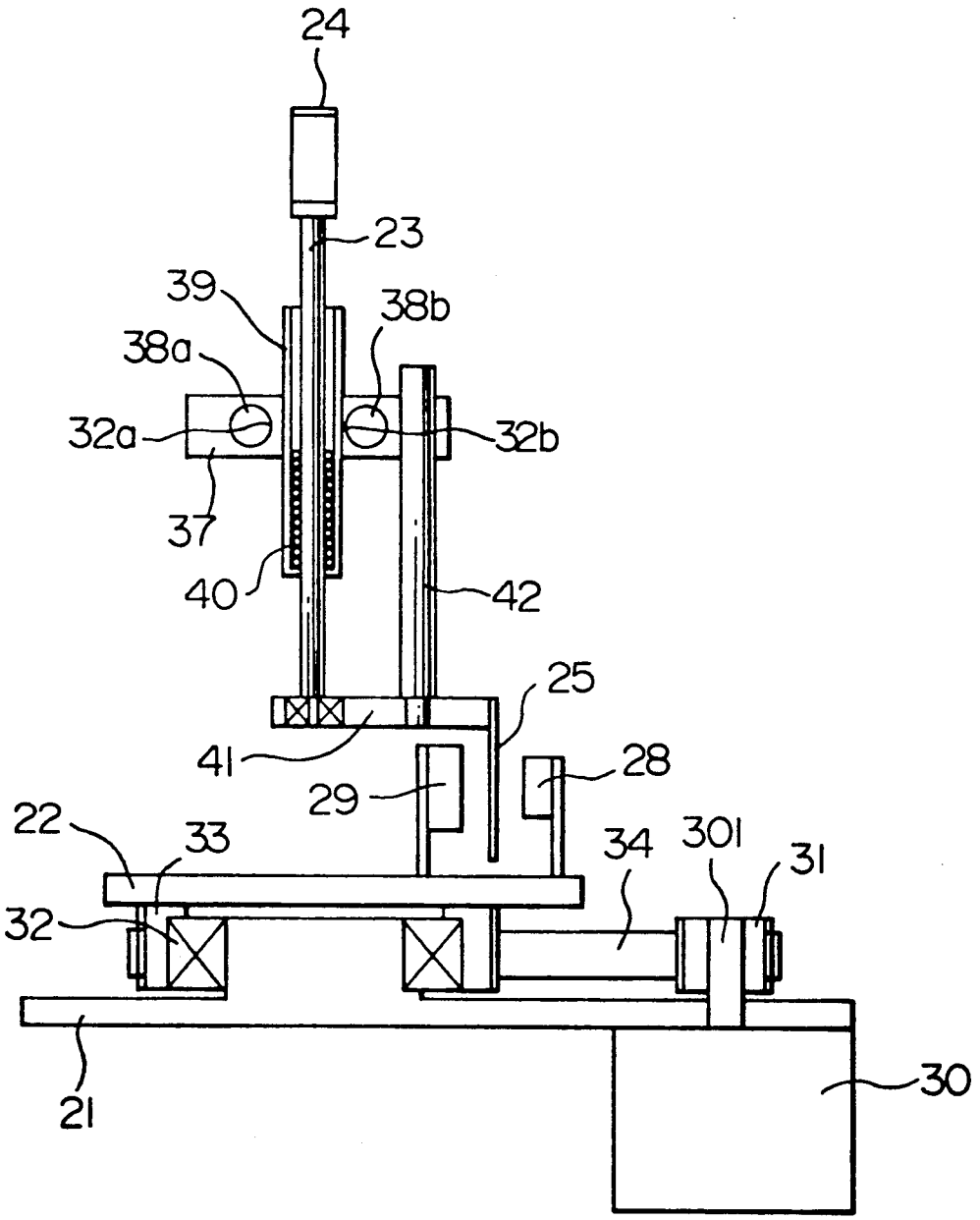
FIG. 2 is a fragmentary cross-sectional view of the detecting portion in FIG. 1.

Then, the detecting portion 2*b* of the eyeglasses frame tracing device 2 which is a first embodiment of the invention will be described below with reference to FIGS. 1 and 2. FIG. 1 is a perspective view of the detecting portion 2*b* of this embodiment and FIG. 2 is a fragmentary cross-sectional view thereof.

The eyeglasses frame tracing device 2 of the first embodiment mainly comprises a horizontally movable base 21, a rotary base 22 which is rotatably supported by the movable base 21, a measuring element shaft 23 including a measuring element 24 at its upper end, a light-shielding plate having two slits 26 and 27 which extend non-parallel with each other, a light emitting diode 28 and a linear image sensor 29 in one pair which are fixed on the rotary base 22 opposite to each other with the light-shielding plate 25 being interposed therebetween.

The movable base 21 is a plate having a substantially square shape and it is supported to be horizontally movable by a base (not shown). A pulse motor 30 is fixed on the lower surface of the movable base 21, and an output shaft 301 of the pulse motor 30 is protruded from an upper surface of the movable base 21. A pulley 31 is supported by the output shaft 301. Also, the movable base 21 includes a cylindrical projecting portion on its upper surface, the projecting portion retaining a bearing 32.

The rotary base 22 is a plate having a substantially rectangular shape and it is integrally formed with a cylindrical pulley 33 on its lower surface. The pulley 33 is supported by the bearing 32, thereby allowing the rotary base 22 to rotate freely.

Reference numeral 34 is a belt which is extended between the pulley 31 and the pulley 33, for the purpose of transmitting rotation of the pulse motor 30 to the rotary base 22.

References 35*a* and 35*b* are retainer plates which are vertically provided at the sides of the rotary base 22. Two rod-like rails 36*a* and 36*b* are supported horizontally as well as in parallel with each other between the retainer plates 35*a* and 35*b*.

Reference numeral 37 designates a movement block with two axial holes 38*a* and 38*b* extending parallel with each other. The movement block 37 moves on the rails 36*a* and 36*b* because the rails 36*a* and 36*b* are penetrated through the axial holes 38*a* and 38*b*. A cylindrical bearing holder 39 is vertically secured at the center of the movement block 37. The measuring element shaft 23 extends through the bearing holder 39. Since there are a plurality of bearings 40 between the measuring element shaft 23 and the bearing holder 39, the measuring element shaft 23 is capable of freely rotating and moving vertically. The measuring element 24 whose distal end exists on the axial center of the measuring element shaft 23 is secured to the upper end of the measuring element shaft 23. The lower end of the measuring element shaft 23 is rotatably attached to an arm 41, the arm 41 being arranged in such a manner that it is not rotated by being secured to a pin 42 which is fixed to the movement block 37 so as to extend vertically downward.

Figure 3:
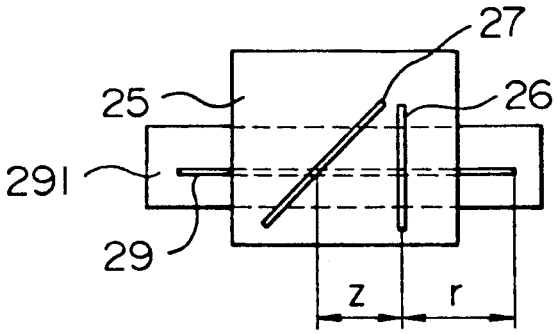
FIG. 3 is an explanatory view illustrative of a positional relation between a light-shielding plate and a linear image sensor.

The light-shielding plate 25 as shown in FIG. 3 is secured at the top end of the arm 41. The light-shielding plate 25 is a rectangular thin plate formed with a slit 26 extending perpendicularly with respect to the longitudinal direction of the light-shielding plate and a slit 27 extending at an angular interval of 45° with respect to the longitudinal direction thereof, as shown in FIG. 3. Walls which are not shown are provided on edges of the respective slits 26 and 27 for shielding light in an oblique direction. The light-shielding plate 25 moves horizontally as well as vertically in accordance with the movement of the measuring element shaft 23, but it does not rotate because it is secured to the arm 41.

The pair of the light emitting diode 28 and the linear image sensor 29 are provided to have large extensions in the lateral direction, the light emitting diode and the linear image sensor being extended opposite to each other such that the light-shielding plate 25 is interposed therebetween. As shown in FIG. 3, the linear image sensor 29 has a one-dimension light receiving section 291.

A constant torque spring 43 which always pulls the movement block 37 toward the distal end of the measuring element 24 is mounted on a drum 44 rotatably supported by the rotary base 22. A top end of the constant torque spring 43 is securely fixed to the movement block 37.

An operation of the device of the invention will now be described.

An eyeglasses frame is held by the clamp portion 2*a* and the top end of the measuring element 24 is brought into contact with a V-groove bottom of the frame.

Then, the pulse motor 30 is rotated at a predetermined rotational pulse number, while the measuring element shaft 23 integrally formed with the measuring element 24 moves on the rails 36*a* and 36*b* following a variable radius of the lens frame or moves vertically following a curved outline of the lens frame.

By the movement of the measuring element shaft 23, the light-shielding plate 25 moves vertically and laterally between the light emitting diode 28 and the linear image sensor 29 in correspondence with the variable radius and the curved outline of the lens frame so that the light-shielding plate 25 interrupts light from the light-emitting diode 28.

Light which has passed through the slits 26 and 27 formed in the light-shielding plate 25 arrives at the light receiving section 291 of the one-dimension linear image sensor 29 and a movement amount of the light is determined by the linear image sensor 29. As shown in FIG. 3, a position of the slit 26 is determined as the variable radius r; and a positional difference of the slit 26 and the slit 27 is determined as a height z of the lens frame. This calculation can readily be carried out since the slit 27 is inclined at 45 degrees.

The slit 27 is not always necessary to be inclined at 45 degrees. Unless the slit 27 is parallel with the slit 26, even if the slit 27 is inclined at any angle, three-dimensional coordinates can be obtained by calculating the detected results.

Moreover, the slit 26 is not always required to be vertical so shown in FIG. 3 if it is not parallel with the slit 27. However, it is needless to say that both of the slits must not be provided horizontally. Of course, one bent slit is included in the scope of the present invention.

When an n-point measurement is thus carried out, the configuration of the lens frame can be recognized in each manner as (rn, $\theta$n, zn) (n=1, 2, . . . N). In addition, $\theta$n means a rotational angle of the motor.

Figure 4:
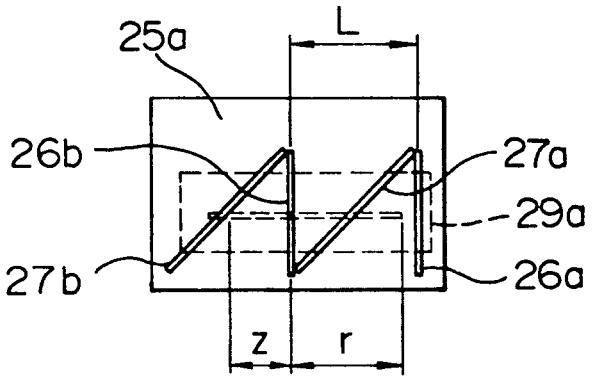
FIG. 4 is an explanatory view illustrative of a modified positional relation between the light-shielding plate and the linear image sensor.
Figure 5:
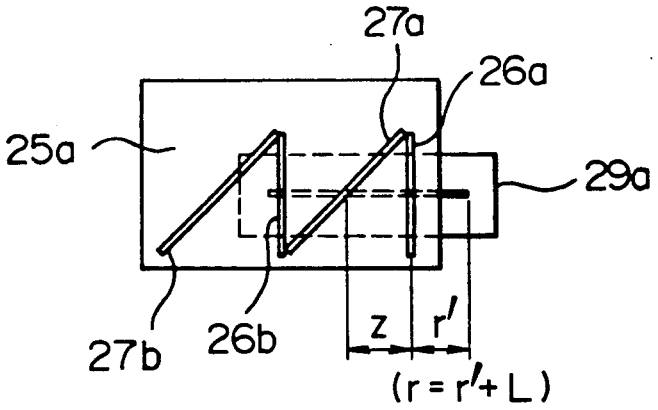
FIG. 5 is an explanatory view illustrative of another positional relation different from that of FIG. 4.

Another example of the light-shielding plate will be described below with reference to FIGS. 4 and 5. FIG. 4 is a view showing a modified positional relation between the light-shielding plate 25*a* and the linear image sensor 29*a*. FIG. 5 is a view showing another positional relation between the light-shielding plate 25*a* and the linear image sensor 29*a*.

As shown in FIG. 4, a distance between the slit 26*a* and the slit 26*b* is represented by a character L. In case of the positional relation as shown in FIG. 4, r and z are found from the positional relation between the slit 26*b* and the slit 27*b* without taking the distance L into consideration. When the light-shielding plate 25*a* moves to a position as illustrated in FIG. 5, r' and z are found at first from the positional relation between the slit 26*a* and the slit 27*a* as shown in FIG. 5, and r and z are then found depending on the basis of the relation of $r=r'+L$.

In this way, by providing a plurality of pairs of slits, the one-dimension linear image sensor can be reduced in size.

Although the embodiment in which the one-dimension linear image sensor is used at the light receiving section, has been described so far, if an area image sensor is employed at the light receiving section, the above-described object can be achieved with a further simple structure. More specifically, as shown in FIGS. 8 and 9, opening means forward in a light-shielding plate 125 may not be a slit but a pin hole 126 so that an area image sensor 129 can detect a position where it receives light as r and z.

Figure 10:
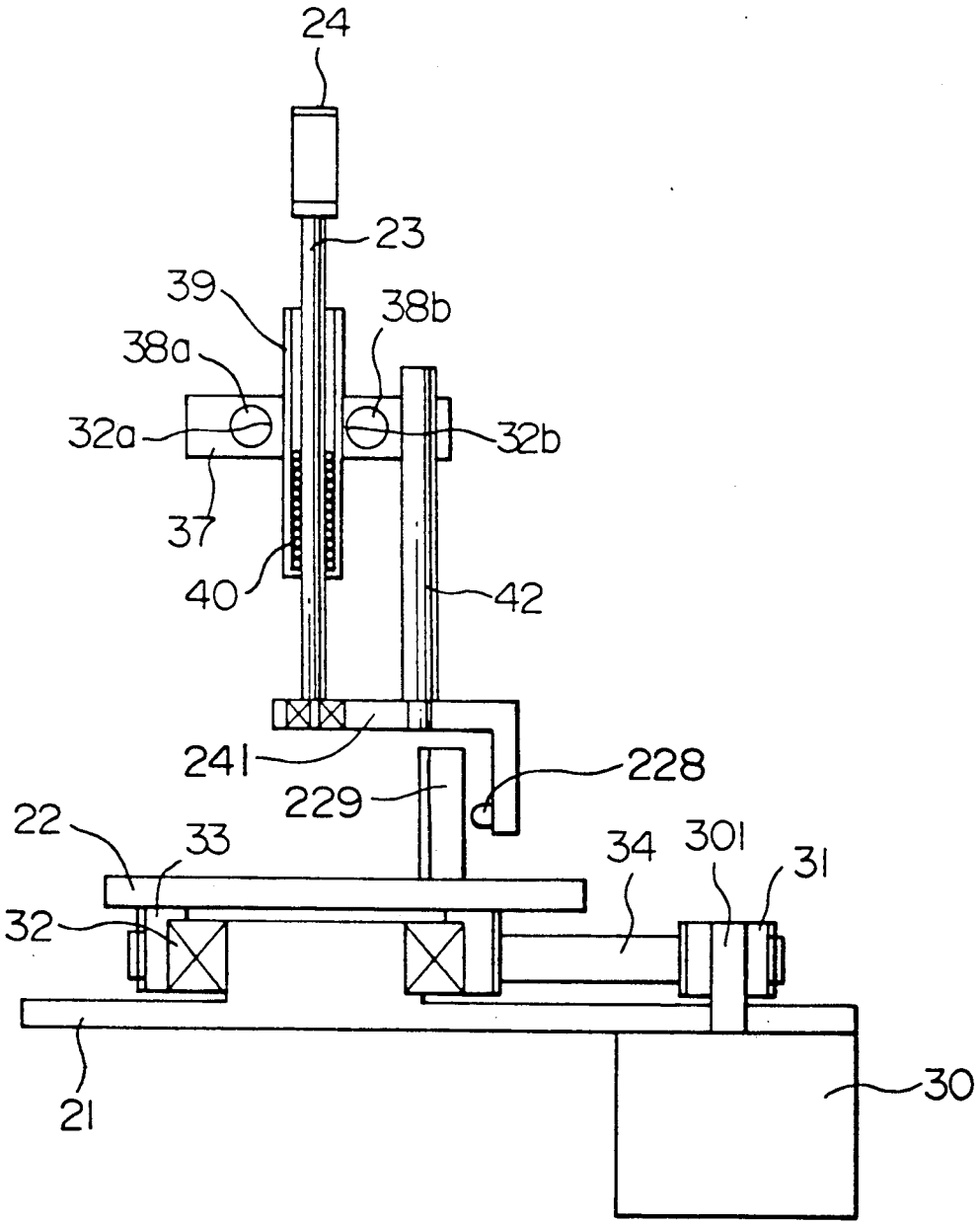
FIG. 10 is a cross-sectional view of a second embodiment of the detecting portion of the eyeglasses frame tracing device according to the invention.

Further, as understood from a second embodiment shown in FIG. 10, a light emitting diode 228 with a lens is directly attached to a distal end of an arm 241 so as to correspond to an area image sensor 229, to thereby eliminate the light-shielding plate 25 of the first embodiment. Thus, the eyeglasses frame tracing device according to this embodiment will be simplified in structure.

Figure 8:
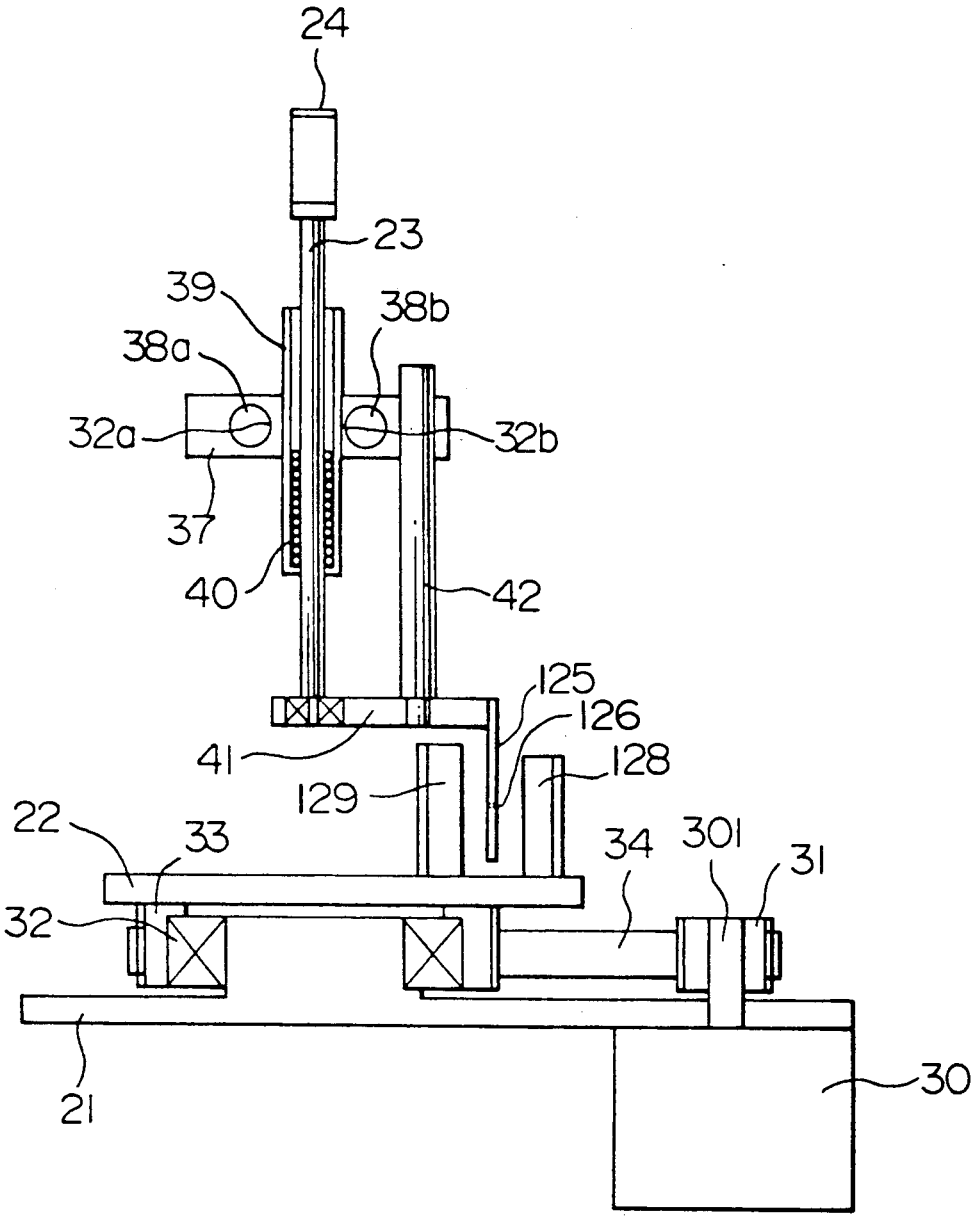
FIG. 8 is a cross-sectional view which illustrates a modified example of the detecting portion of the eyeglasses frame tracing device shown in FIG. 1.
Figure 9:
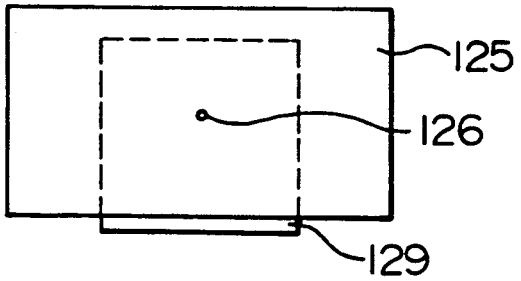
FIG. 9 is a view illustrating a positional relation between a light-shielding plate and an area image sensor of FIG. 8.

Component parts in FIGS. 8, 9 and 10 like as those in FIGS. 1 and 2 are denoted by common reference numerals and the description thereof will be omitted.

According to the present invention, since one detector determines a three-dimensional position along each inner peripheral portion of the eyeglasses frame, a small-sized and inexpensive eyeglasses frame tracing device can be realized.

What is claimed is:

1. An eyeglasses frame tracing device comprising:

a horizontally movable base portion;

a rotary base rotatably supported on said base portion;

a shaft having a measuring element at its upper end, the shaft being retained on said rotary base and relatively moving in the vertical direction and in a lateral direction with respect to said rotary base;

a light-shielding plate which moves in association with the vertical movement and the lateral movement of said measuring element shaft and which includes opening means to allow a part of light to pass therethrough; and a pair of a light emitting section and a light receiving section which are provided opposite to each other with said light-shielding plate being interposed therebetween, and which moves integrally with said rotary base.

2. An eyeglasses frame tracing device according to claim 1, characterized in that said opening means comprises at least two slits extending non-parallel with each other, and said light receiving section is a linear image sensor.

3. An eyeglasses frame tracing device according to claim 1, characterized in that said opening means comprises a pin hole, and said light receiving section is an area image sensor.

4. An eyeglasses frame tracing device comprising:

a horizontally movable base portion;

a rotary base rotatably supported on said base portion;

a shaft having a measuring element at its upper end, the shaft being retained on said rotary base and relatively moving in the vertical direction and in a lateral direction with respect to said rotary base;

a light emitting section which moves in association with the vertical movement and the lateral movement of said measuring element shaft; and a light receiving section having an area image sensor, the light receiving section extending opposite to said light emitting section and moving integrally with said rotary base.

* * * * *